United States Patent [19]

Fish

[11] Patent Number: 4,603,678

[45] Date of Patent: Aug. 5, 1986

[54] BELT-CONFIGURED SAW FOR CUTTING SLOTS INTO STONE

[75] Inventor: Donald D. Fish, Bedford, Ind.

[73] Assignee: W. F. Meyers Company, Inc., Bedford, Ind.

[21] Appl. No.: 657,833

[22] Filed: Oct. 5, 1984

[51] Int. Cl.[4] ..... B28D 1/08

[52] U.S. Cl. ..... 125/21; 51/395; 51/136; 51/357

[58] Field of Search ..... 299/35, 36; 125/18, 125/21; 51/395, 399, 136, 396, 397, 398, 357

[56] References Cited

U.S. PATENT DOCUMENTS

| | | | |
|---|---|---|---|
| 2,059,583 | 11/1936 | Jackson | 51/397 |
| 3,534,508 | 10/1970 | Del Vecchio | 51/399 |
| 3,598,101 | 8/1971 | Hensley | 125/21 |
| 3,884,212 | 5/1975 | Armstrong | 125/21 |
| 4,181,115 | 1/1980 | Weisner | 125/21 |
| 4,384,564 | 5/1983 | Smith | 125/21 |

FOREIGN PATENT DOCUMENTS

| | | | |
|---|---|---|---|
| 70506 | 1/1983 | European Pat. Off. | 299/35 |
| 2107454 | 8/1972 | Fed. Rep. of Germany | 51/399 |
| 527732 | 10/1921 | France | 51/136 |
| 1113453 | 3/1956 | France | 51/136 |
| 963842 | 10/1982 | U.S.S.R. | 125/21 |

*Primary Examiner*—Harold D. Whitehead

*Attorney, Agent, or Firm*—Woodard, Weikart, Emhardt & Naughton

[57] ABSTRACT

A stone cutting device including a continuous flexible cutting belt for cutting a slot in stone which is in the ground. The device includes a main frame, a jib pivotally mounted to the main frame, aligned sheaves rotatably mounted to the main frame and jib, a continuous flexible cutting belt extending around and in driven engagement by the sheaves, and a means to rotate at least one of the sheaves. The continuous flexible cutting belt includes a plurality of spaced apart abrasive cutting elements extending across the top and sides of the belt. The cutting elements are flush with the remainder of the top and side surfaces of the belt which includes a molded-in-place resilient material. Belt strength is provided by a flexible cable extending through the length of the belt.

19 Claims, 8 Drawing Figures

BELT-CONFIGURED SAW FOR CUTTING SLOTS INTO STONE

BACKGROUND OF THE INVENTION

This invention relates in general to stone cutting devices and in particular to such a device having a flexible and continuous stone cutting belt.

For the purposes of removing hard natural stone from quaries and further processing it, means for cutting stone have been developed and improved on over the years. Various wire saws have been designed to cut stone after it is removed from the ground. For example, the U.S. Pat. No. 3,598,101 issued to Hensley describes a continuous wire saw with cutting elements attached. In U.S. Pat. No. 3,884,212, I disclosed an improved wire saw comprising abrasive cutting elements sleeved over an endless flexible wire and a pressure molded-in-place resilient material surrounding the cable and providing a substantially uniform diameter for the endless saw. This saw is commonly used in stationary wire saw stands wherein the wire saw is engaged by two sheaves located on either side of the block of stone being sawed. My patented wire saw is also adaptable for cutting stone which is still in the ground. In this application, holes must first be drilled in the stone through which the wire saw is threaded and then reattached and drivenly engaged by a single pulley. Despite the ability to use my wire saw in a quary application, it is desireable to have a continuous running device for cutting stone in the ground which does not require the tasks of drilling holes and threading and reattaching a wire saw.

Other methods and devices for removing stone from the ground are currently in use. It is known to drill holes in stone and then wedge large pieces of stone out with mechanical means employing hydraulics and pneumatics. This method is difficult, time consuming and does not result in a smooth, cut surface on the stone. A device is known to be used in Europe which includes a jib pivotally mounted to a vehicle, having aligned sprockets and a guide bar to drive a continuous chain on which diamond cutting bits are attached for cutting stone. The jib travels through the stone as it is cut away by the chain saw. Several problems are associated with using this chain-type saw. The chain is heavy, expensive and must be run at slow speeds because of its mechanical construction. The chain also causes vibration during operation and wears out easily. Should the chain break during operation, it may perilously fly off the jib.

While improvements in the wire saw have resulted in less expensive, smoother, faster and safer operation of stationary wire saw devices, these advantages have not been heretofore available in the quary application where a jib is used. The invention disclosed herein is addressed to overcoming this problem.

SUMMARY OF THE INVENTION

One embodiment of the present invention is a device for cutting a slot in stone comprising a main frame, a jib movably mounted to the main frame, a pair of spaced apart and aligned sheaves with at least one of the sheaves having lateral width and being mounted to the jib, a means on the frame connected to and being operable to rotate at least one of the sheaves, and a continuous flexible belt with a top and opposite sides and extending around and in driven engagement by the sheaves, including a plurality of spaced apart abrasive cutting strips extending across the top and sides of the belt which are flush with the belt, said sides defining the width of the belt which is sized greater than the lateral width of the sheave on the jib, enabling the sheave to pass through a slot cut by the belt as the jib moves the belt through the slot.

Another embodiment of the present invention is a stone cutting belt comprising a flexible and continuous main body with length having a top surface, a pair of opposite side surfaces and a bottom surface wherein the bottom surface is configured to be drivenly engaged by a sheave and the side surfaces are spaced apart and positioned outwardly of the sheave, a flexible elongated member extending through the main body along its length and located inwardly of the side surface providing belt strength, and a plurality of stone cutting elements mounted to the main body and spaced along its length, each element being flush with the top surface and opposite side surfaces and cutting a slot in stone as the belt and the sheave passes therethrough.

One object of the present invention is to provide an improved stone cutting device employing a stone cutting belt.

Another object of the present invention is to provide a device for cutting stone which is in the ground.

Yet another object of the present invention is to provide a device for high speed cutting of a slot in stone which is in the ground.

It is a further object of the present invention to provide a device for cutting stone which is in the ground, where the cutting elements are protected by adjacent resilient material.

Another object of the present invention is to provide a belt-configured device for cutting stone which is in the ground.

Related objects and advantages of the present invention will be apparent from the following description.

DESCRIPTION OF THE PREFERRED EMBODIMENTS

Figure 1:
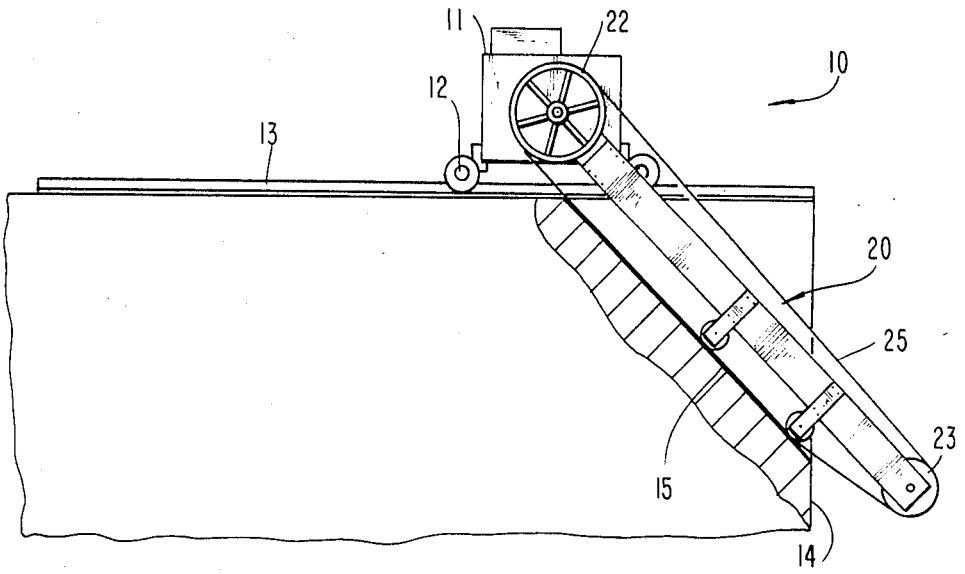
FIG. 1 is a fragmentary side view of a device cutting a slot in stone according to a typical embodiment of the present invention.
Figure 2:
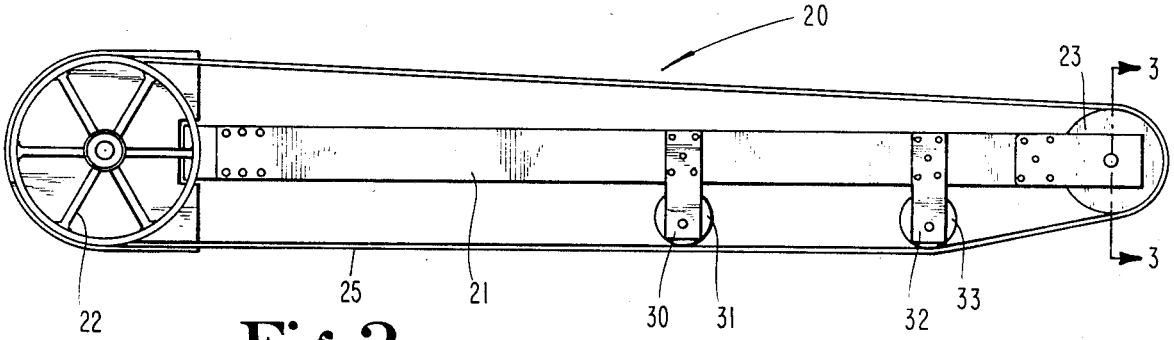
FIG. 2 is an enlarged side view of the jib comprising a portion of the FIG. 1 stone cutting device.

For the purposes of promoting an understanding of the principles of the invention, reference will now be made to the embodiment illustrated in the drawings and specific language will be used to describe the same. It will nevertheless be understood that no limitatinof the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1 there is shown a device 10 for cutting a slot 15 in stone 14 located in the ground. Device 10 includes a vehicle 11 movably mounted atop a pair of conventional rails 13. Vehicle 11 includes four wheels 12 rotatably mounted to the bottom end of the vehicle frame with a pair of wheels located on one side of the vehicle engaging one of the rails and with the second pair of wheels mounted to the opposite side of the vehicle engaging the second rail. A braking means is used in the present embodiment of device 10 to prevent relative motion between vehicle 11 and rails 13 during operation.

Vehicle 11 includes a jib 20 pivotally mounted to the main frame of the vehicle with jib 20 including a pair of sheaves 22 and 23 rotatably mounted to the opposite ends of the jib. Sheaves 22 and 23 are spaced apart and are aligned. Jib 20 includes an elongated member 21 with the opposite ends thereof having sheaves 22 and 23 rotatably mounted in a conventional fashion. A pair of downwardly extending legs 30 and 32 are fixedly mounted to elongated member 21. A pair of idler sheaves 31 and 33 are rotatably mounted in a conventional manner to the bottom end of legs 30 and 32. Belt saw 25 extends in continuous fashion around sheaves 22 and 23 and immediately adjacent and in contact with idler sheaves 31 and 33.

Vehicle 11 includes a shaft 30 rotatably mounted thereto and extending through the opposite sides of the vehicle. One end of shaft 30 includes a pulley wheel 31 fixedly secured thereto in driven engagement with V-belt 32 in turn extending around and driven by a pulley wheel 33 mounted to the output shaft of a conventional motor 39 mounted to the vehicle. The opposite end of shaft 30 has sheave 22 fixedly secured thereto which is in driving engagement with belt 25. Thus, operation of motor 39 causes rotation of shaft 30 and movement of belt 25.

Flange 34 is pivotally mounted by conventional bearings to vehicle 11 about the axis of rotation of shaft 30. Elongated member 21 is fixedly secured to flange 34 on one side of shaft 30 whereas a plurality of gear teeth 35 are fixedly mounted to flange 34 on the opposite side of shaft 30. Teeth 35 are in meshing engagement with a conventional worm gear 36 in turn rotated by a hand crank 37. A conventional gear box 38 is positioned between hand crank 37 and worm gear 36. The operator may therefore rotate hand crank 37 causing rotation of worm gear 36 and thus pivotal motion of the elongated member 21 and the jib about the axis of rotation of shaft 30.

Figure 8:
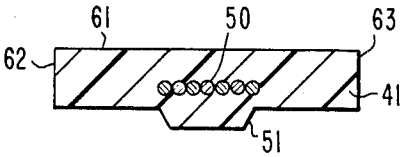
FIG. 8 is a cross-sectional view of the cutting belt of FIG. 6, taken along line 8—8 of FIG. 6 and viewed in the direction of the arrows.

Saw belt 25 is a continuous flexible belt which extends around and is in driven engagement by the aligned sheaves 22 and 23. Belt 25 includes a continuous flexible main body 41 which is produced from polyurethane or other suitable plastic or flexible material. The main body 41 of the belt includes a wire cable 50 which extends through the length of the belt main body to increase the strength thereof. As shown in FIG. 8, the cable is arranged in a plurality of rows which extend at least partially across the width of the belt main body. In the preferred embodiment, the belt includes a single cable which extends multiple times around the length of the belt thereby forming the multiple rows. Alternatively, a purality of wire cables may be arranged in side-by-side fashion with each cable extending through the length of the belt.

Figure 3:
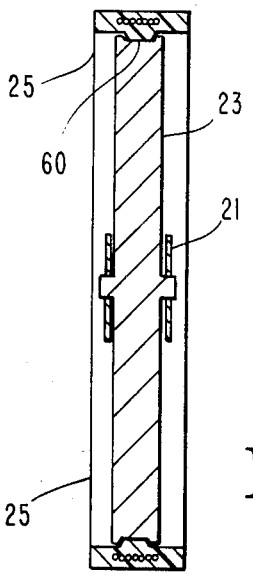
FIG. 3 is an enlarged cross-sectional view of a portion of the jib shown in FIG. 2, taken along line 3—3 in FIG. 2 and viewed in the direction of the arrows, particularly showing the lateral width of the sheave and member holding the sheave, in relation to the width of the cutting belt.
Figure 4:
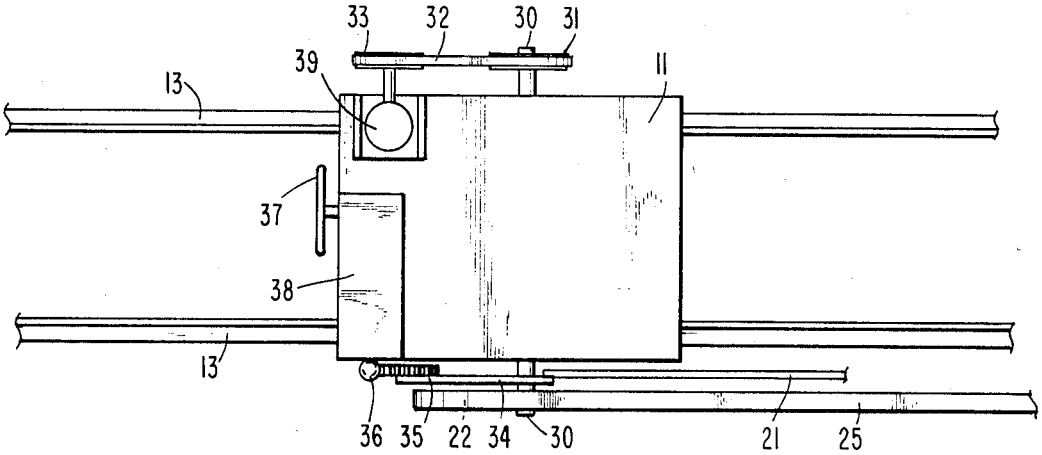
FIG. 4 is a fragmentary enlarged top view of the device shown in FIG. 1.
Figure 5:
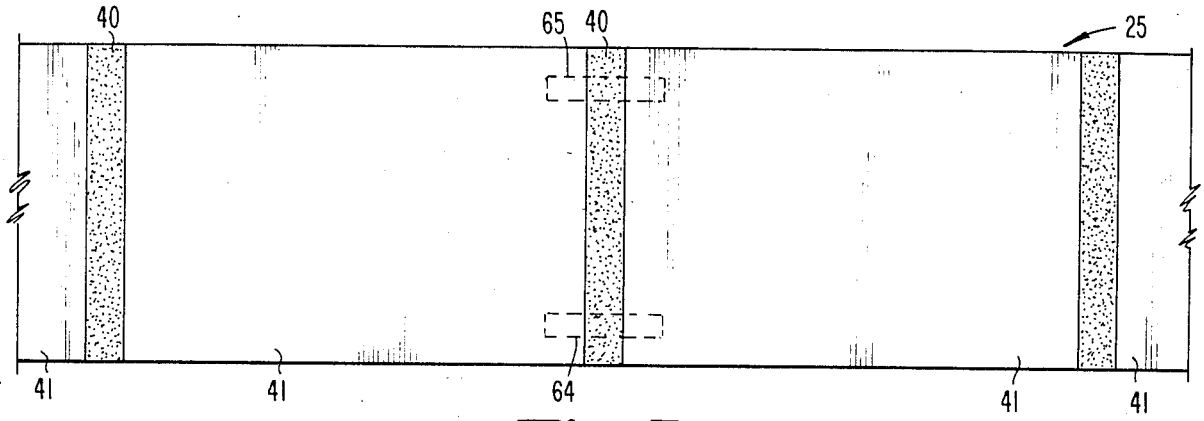
FIG. 5 is a top view of a portion of the cutting belt.

The bottom end 51 of the belt main body is configured as a truncated V-shaped projection extending complementarily into the outer circumference 60 (FIG. 3) of each sheave 22, 23, 31 and 33 thereby enabling sheave 22 to drivingly engage the belt. The top surface 61 of the belt main body is flat and is arranged perpendicularly relative to the flat sides 62 and 63 of the belt.

Belt 25 includes a plurality of spaced apart abrasive cutting strips 40 which extend across the top and sides of the belt and are flush therewith. Abrasive cutting strip 40 (FIG. 7) includes a top flat surface 44 arranged perpendicularly relative to the opposite flat sides 43 of the strip. Each strip 40 may be produced from a powdered metal mix such as bronze having diamonds of a size of U.S. 16–20 mesh positioned uniformly throughout. The powdered metal and bronze is inserted into a resistance sintering press and heated to 1800° F. Such a press is available from Dr. Fitch GmbH, Stuttgart, Germany.

The main body 41 of the belt is produced by initially tensioning cable 50 at approximately 1,000 pounds tension and then coating the cable with a primer to cause plastic to adhere thereto. The abrasive cutting strips are then placed in an injection mold with the mold being at approximately 150° F. Polyurethane is then ejected into the mold to encapsulate the cable. The encapsulated belt is then cured at 280° F. In one embodiment, approximately seven and one-half feet of belt was produced in a mold at a time. The top surface 44 of the abrasive cutting strip is positioned flush with the top surface 61 of the main body 41. Likewise, the opposite sides 43 of the abrasive cutting strip are flush with the opposite sides 62 and 63 of the main body. As the belt is moved across stone 14 to cut slot 15 therein, the plastic main body of the belt positioned between the abrasive cutting strips 40 wears so that the top surface and side surfaces of the plastic are located approximately 0.015 inches below the top and side surfaces of the abrasive cutting strips. Thus, the abrasive cutting strips are protected from snagging on external objects and likewise, vibration problems are minimized. Best results have been obtained by operating device 10 at belt speeds of between 3000 and 6000 feet per minute.

Figure 6:
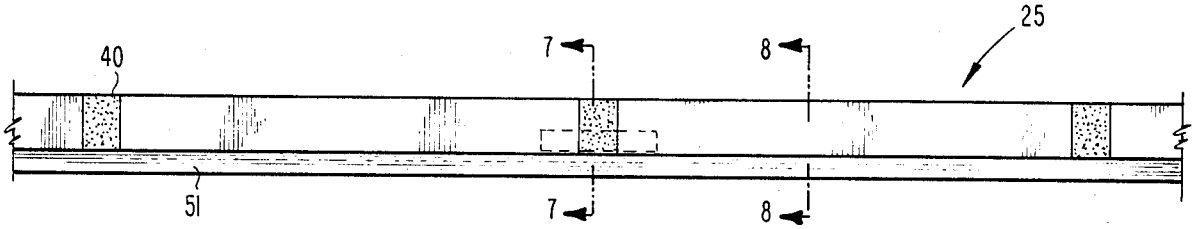
FIG. 6 is a side view of the cutting belt of FIG. 5.
Figure 7:
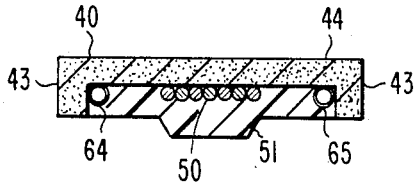
FIG. 7 is a cross-sectional view of the cutting belt of FIG. 6, taken along line 7—7 in FIG. 6 and viewed in the direction of the arrows, particularly showing the shape of the cutting strip and the positioning of the anchoring dowel pins attached thereto.

Each cutting strip is anchored to the main body by a pair of hollow dowel pins 64 and 65 which are silver soldered to each abrasive strip. The bottom side of each strip 40 is indented as shown in FIG. 7 to allow cable 50 to extend therethrough. The cable is not actually affixed to the cutting strip but is merely positioned adjacent thereto. The hollow dowel pins 64 and 65 have lengths sufficient to extend outwardly of each cutting strip such as shown in FIG. 6 and into the adjacent portion of the plastic main body thereby anchoring the abrasive cutting strip to the belt main body.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A device for cutting a slot in stone comprising:
a main frame;
a jib movably mounted to said frame;
a pair of spaced apart and aligned sheaves being rotatably mounted and with at least one of said sheaves having lateral width and being mounted to said jib;
means on said frame and operably associated with said sheaves being operable to rotate same; and
a continuous flexible belt with a top and opposite sides and extending around and in driven engagement by said sheaves, said belt including a plurality of spaced apart abrasive cutting strips extending across said top and sides of said belt and being flush therewith, said sides defining the width of said belt which is sized greater than said lateral width allowing said one sheave to pass through a slot cut by said belt as said jib moves said belt through said slot.

2. The device of claim 1 and further comprising:
anchoring means attached to said strips and extending into said belt securing said strips thereto.

3. The device of claim 2 wherein:
said belt includes multiple loops of cable extending through the length thereof.

4. The device of claim 3 wherein:
said belt is of a resilient material with said cable extending through said resilient material.

5. The device of claim 4 wherein:
said belt is shaped such that said opposite sides are perpendicular to said top, said belt having a bottom surface with a bottom truncated V-shaped projection extending along the length thereof, said projection drivenly engaged by complementary channels in the outer circumference of said sheaves.

6. The device of claim 5 wherein:
said strips having a flat top surface arranged perpendicularly to outside opposite flat side surfaces, said strips also having a bottom surface including an indentation forming an indented bottom surface and inside opposite side surfaces.

7. The device of claim 6 wherein:
said strips are of pressed powdered metal and diamond composition.

8. The device of claim 1 and further comprising:
a vehicle moveable atop said stone and wherein: said jib including an elongated member with a proximal end and a distal end with said proximal end pivotally mounted to said vehicle, said sheaves mounted to said member, said belt having a width greater than the width of said member to allow said member to pivot through said slot.

9. A stone cutting belt comprising:
a flexible and continuous main body with length having a top surface, a pair of opposite side surfaces and a bottom surface, said bottom surface configured to be drivenly engaged by a sheave, said side surfaces spaced apart to be positioned outwardly of said sheave;
a flexible elongated member extending through said main body along the length thereof and positioned between said side surfaces providing belt strength; and
a plurality of stone cutting elements mounted to said main body and spaced along the length thereof, each element extending across said top surface and opposite side surfaces and being flush therewith, said elements cutting a slot in stone as the belt and sheave pass therethrough.

10. The device of claim 9 and further comprising:
anchoring pins attached to said strips and extending outwardly from said strips along the longitudinal axis of said belt into said belt securing said strips thereto.

11. The device of claim 10 wherein:
said flexible elongated member is comprised of multiple loops of a single flexible cable, the ends of said cable terminating at different lateral positions along the length of said belt.

12. The device of claim 11 wherein:
said belt is of a resilient material with said cable extending through said resilient material.

13. The device of claim 12 wherein:
said belt is shaped such that said opposite sides are perpendicular to said top, said belt having on its bottom surface a bottom truncated V-shaped projection extending along the length of said belt, said projection drivenly engaged by a complementary channel in the outside circumference of said sheave.

14. The device of claim 13 wherein:
said cutting elements having a flat top surface arranged perpendicularly to outside opposite flat side surfaces, said cutting elements also having a bottom surface including an indentation forming an indented bottom surface and inside opposite side surfaces.

15. The device of claim 14 wherein:
said cutting elements are of pressed powdered metal and diamond composition.

16. A stone cutting belt comprising:
a flexible and continuous main body with length having a top surface, a pair of opposite side surfaces and a bottom surface, said belt having on its bottom surface a bottom truncated V-shaped projection extending along the length of said belt to be drivenly engaged by a sheave, said side surfaces spaced apart to be positioned outwardly of said sheave;
a flexible elongated member extending through said main body along the length thereof and positioned between said side surfaces providing belt strength; and
a plurality of stone cutting elements mounted to said main body and spaced along the length thereof, each element extending entirely across said top surface and opposite side surfaces and extending along only the outer portions of said bottom surface adjacent said side surfaces, said elements being mounted flush along each surface, the extension of each element along the outer portions of said bottom surface extending outwardly of said sheave.

17. The device of claim 16 wherein:
said cutting elements have a flat top surface arranged perpendicularly to outside opposite flat side surfaces, said cutting elements also have a bottom surface including an indentation forming an indented bottom surface and inside opposite side surfaces, said elongated member extending between said inside opposite side surfaces within said indentation.

18. The device of claim 17 and further comprising:
anchoring pins attached to said cutting elements and extending outwardly therefrom along the longitudinal axis of said belt into said main body securing said strips to said belt.

19. The device of claim 18 wherein:
said anchoring pins are positioned and attached to said cutting elements within said indentation.

* * * * *